US005854484A

United States Patent [19]

Bergmann

[11] Patent Number: 5,854,484

[45] Date of Patent: Dec. 29, 1998

[54] COLLISION CELL WITH INTEGRATED ION SELECTOR FOR MS/MS-TIME-OF FLIGHT MASS-SPECTROMETER

[76] Inventor: Thorald Horst Bergmann, Buchenweg 9a, D-82441 Ohlstadt, Germany

[21] Appl. No.: 903,243

[22] Filed: Jul. 24, 1997

[30] Foreign Application Priority Data

Aug. 1, 1996 [DE] Germany ..... 196 31 162.4

[51] Int. Cl.[6] ..... H01J 49/40

[52] U.S. Cl. ..... 250/287

[58] Field of Search ..... 250/287, 288, 250/281, 282

[56] References Cited

U.S. PATENT DOCUMENTS

| | | | |
|---|---|---|---|
| 5,032,722 | 7/1991 | Boesl et al. . | |
| 5,202,563 | 4/1993 | Cotter et al. . | |
| 5,654,545 | 8/1997 | Holle et al. | 250/287 |

FOREIGN PATENT DOCUMENTS 0 403 965 6/1990 European Pat. Off. .

OTHER PUBLICATIONS

D. J. Beussman et al: "Tandem Reflectron Time–of–Flight Mass–Spectrometer Utilizing Photodissociation" Analytical Chemistry, 1995, pp. 3952–3957, vol. 67(21) American Chemical Society.

B. Spengler et al.: "Fundamental Aspects of Postsource Decay in Matrix–Assisted Laser Desorption Mass Spectrometry 1. Residual Gas Effects" Journal of Physical Chemistry, 1992, pp. 9678–9684, vol. 96, American Chemical Society.

T. J. Cornish et al: "A Curved–field Reflectron for Improved Energy Focusing of Product Ions in Time–of–Flight Mass Spectrometry" Rapid Communications in Mass Spectrometry, 1993, pp. 1037–1040 vol. 7, John Wiley & Sons.

R. D. Beck et al: "Tandem time–of–flight mass spectrometer for cluster–surface scattering experiments." Review of Scientific Instruments, 1995, pp. 4188–4197, vol. 66, American Institute of Physics.

H. Haberland et al: "Converting a reflectron time–of–flight mass spectrometer into a tandem instrument" Review of Scientific Instruments, 1997, pp. 2368–2371, vol. 62, American Institute of Physics.

*Primary Examiner*—Kiet T. Nguyen

[57] ABSTRACT

An MS/MS-time-of-flight mass-spectrometer for colliding ions with the molecules or atoms of some collision gas. In order to assign the fragment ions to their respective parent ions, some ion selecting mechanism such as an ion gate must be used to preselect one specific mass of the primary ion spectrum. Usually the combination of both elements, a collision cell and an ion selector will need so much space that the size of the mass-spectrometer will increase, also reducing its sensitivity. This effect can be avoided, by integrating ion selector and collision cell into one unit.

6 Claims, 3 Drawing Sheets

COLLISION CELL WITH INTEGRATED ION SELECTOR FOR MS/MS-TIME-OF FLIGHT MASS-SPECTROMETER

BACKGROUND OF THE INVENTION

1. Field of the Invention

This invention relates to collision cells for time-of-flight mass-spectrometers capable of preselecting ions, fragmenting these ions and then performing mass analysis of the fragmented ions. This function is generally termed as MS/MS-experiment or double mass analysis.

Time-of-flight mass-spectrometers capable of performing MS/MS-experiments usually have at least two paths of flight where ions are separated according to their masses. Always the end of one path of flight will be the starting point of the next path of flight.

Usually the first path of flight will be used to preselect some specific mass range of ions from all the ions that have been started on this path. Before or after selection this group of ions will then be modified by some specific interaction, that can be effected by a laser beam, crossing with a second particle beam or collision with molecules of some gas deliberately introduced into the interaction region.

A number of methods can be used for preselecting specified mass ranges in time-of-flight mass-spectrometers:

If the flight paths are placed orthogonally to each other, selection of a specified mass range can be effected by placing the end of the first path into the extraction optics of the second path, and switching on the extraction optics for the second flight path exactly when the desired mass range of ions is passing through the extraction optics. In this manner only the desired mass range will be deflected from its original path onto the second path.

If flight paths are colinearly arranged, then some method of pulsed deflection of the unwanted ions must be used:

a) It is possible to arrange two plates parallel to the axis of the beam. Holding these plates usually at two different potentials and just shortly switching voltages to identical potentials will only let a correspondingly short mass range of ions pass uneffected into the next flight path.

b) It is also possible to use two sets of interdigitally arranged parallel wires. Each of these two sets is connected to one power supply. Keeping both sets at the same potential as the flight path of the ions will let the ions pass uneffected. Charging these two sets to potentials symmetrically opposite to the potential of the flight path will deflect passing ions from their original path so they no longer reach the detector. Such an ion gate can deflect passing ions with comparativly low voltages and also produces electrical fields only in its very close vicinity. These features generally allow performing the mass selection with high mass resolution. Such an ion gate has been described e.g. in the publication of D. J. Beussman et al. (Analytical Chemistry, vol. 67, pages 3952–3957, 1995).

In order to extract additional information about these preselected ions their internal state will have to be modified, often by increasing their internal energy. This will cause these ions to fragment. Measuring the fragment masses will give clues to the structure of the unfragmented ions, which is one of the prominent uses of this method. These fragment masses will be determined by measuring their time-of-flight in the second flight path of the mass-spectrometer.

If it is necessary to determine more than only the mass of the fragments, it is possible to arrange a second interaction zone, filtering a mass range after or before interaction, and then using a third flight path for mass analysis of these ions that now have been modified two times.

2. Description of the Related Art

Often the internal energy of the ions is increased by colliding them with atoms of some gas, Argon, Nitrogen or Helium being the most often used gases. Very often Helium has turned out to be the best candidate.

State of the art shows two arrangements using collision gas for the production of fragment ions:

a) B. Spengler et al. (Journal of Physical Chemistry, vol. 96, pages 9678–9684, 1992) analyse the fragmentation of the molecule Cytochrom C by introducing a number of gases up to pressures of $4 \cdot 10^{-5}$ mbar into the flight path of their mass-spectrometer.

b) T. J. Cornish et al. (Rapid Communications in Mass Spectrometry, vol. 7, pages 1037–1040, 1993) analyse the fragmentation of molecules by introducing Helium or Argon with a pulsed nozzle into the collision cell of their double time-of-flight mass-spectrometer. The collision cell is located between the two symmetrically arranged flight paths of their mass-spectrometer.

The simplest method of fragmentation has been employed by B. Spengler et al. by introducing the collision gas directly into the flight path of the mass-spectrometer. This is the cheapest method for fragmenting ions and can also very easily be set up. The main disadvantage of this method is, that it usually will be necessary to introduce large amounts of collision gas into the mass-spectrometer to get sufficient fragmentation of the ions. Especially Helium, which is a favorite candidate as collision gas will have to be introduced in such high amounts that electrical discharges can occur in the vacuum housing of the mass-spectrometer endangering delicate components such as the detector.

The MCP or multichannel plates, often used in the detectors of time-of-flight systems, are usually specified to a maximum background pressure of $10^{-4}$ mBar. Electrical discharges will start at background pressures above $10^{-3}$ mBar.

T. J. Cornish et al. have found a method to effect sufficient fragmentation of their ions using Helium as a collision gas. They use a pulsed nozzle to introduce Helium at high density into their collision cell. By waiting long enough after a Helium pulse they prevent a rising of the background gas pressure to levels that can endanger components of their mass-spectrometer. However, using such a low repetition rate will correspondingly reduce the sensitivity of the mass-spectrometer.

Both the collision cell and the above described ion selectors have a finite spacial extent which, by extending the length of the flight paths tend to reduce the sensitivity of mass-spectrometers, especially when applied to time-of-flight mass-spectrometers.

SUMMARY OF THE INVENTION

Thus it is an object of the invention to provide an MS/MS-time-of-flight mass-spectrometer with both collision cell and ion selector, at the same time allowing maximum sensitivity and mass resolution of the instrument. It is another object of the invention to improve present MS/MS-time-of-flight mass-spectrometer designs providing a simple construction, such that a collision cell with sufficiently high gas pressure for all cases of fragmentation and an ion selector can be implemented with no reduction in sensitivity or mass resolution. It is a specific object of the invention to provide such an arrangement of collision cell and ion selector which allows high pressure gradients between the collision cell and the rest of the mass-spectrometer retaining a high sensitivity of the instrument.

The characterizing features of the invention are given in claim 1.

In accordance with the invention the collision cell and the ion selector will be constructed as one unit, this being the most space saving arrangement of these two elements on the flight path of a time-of-flight mass-spectrometer. This space saving arrangement of collision cell and ion selector will result in the maximum sensitivity of the time-of-flight mass-spectrometer that can be attained under these circumstances.

By using the invention to place the collision cell in the close vicinity to the extraction volume of the time-of-flight mass-spectrometer it is now possible to choose small cross sections for the flow restrictions at the same time passing beams of large divergence through the collision cell into the mass-spectrometer. Ion beams of large divergence will transport a larger number of ions, which effects an increased sensitivity of the mass-spectrometer.

Advantageous implementations of the invention are given in the sub-claims.

DESCRIPTION OF THE PREFERRED EMBODIMENTS

Some implentation examples of the invention will now be described in conjunction with the drawings.

Figure 1:
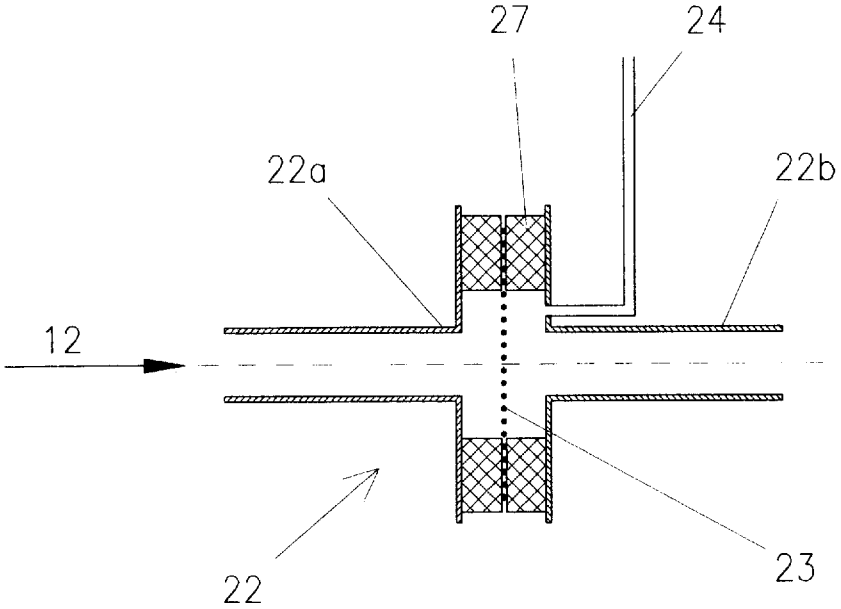
FIG. 1 shows an collision cell with integrated ion selector as part of an MS/MS-time-of-flight mass-spectrometer.

FIG. 1 shows an embodiment of a collision cell(22) with an integrated ion selector(23). This collision cell is a part of an MS/MS-time-of-flight mass-spectrometer. The ion selector is shown here as a parallel wire ion gate and is carried by ceramic rings(27). The collision cell itself is made from two halves(22*a,* 22*b*), that can be pressed or glued together by any known method. Since both halves of the collision cell can be fabricated from metal, the complete unit can easily be mounted within a collision chamber. The collision gas is introduced via tubing(24) which enters the collision cell in close proximity to the ion selector. The wires of the ion selector shown in this embodiment are located in a plane orthogonal to the ion optical axis and split the collision cell into two symmetrical half-parts. By introducing the collision gas close to the center of the collision cell, a maximum pressure within the collision cell can be achieved while simultaneously creating a minimal gas load of within the rest of the collision chamber and the pump that must carry away this gas.

Instead of the parallel wire ion gate, it is also possible to use a parallel plate deflection system for ion selection.

Figure 2:
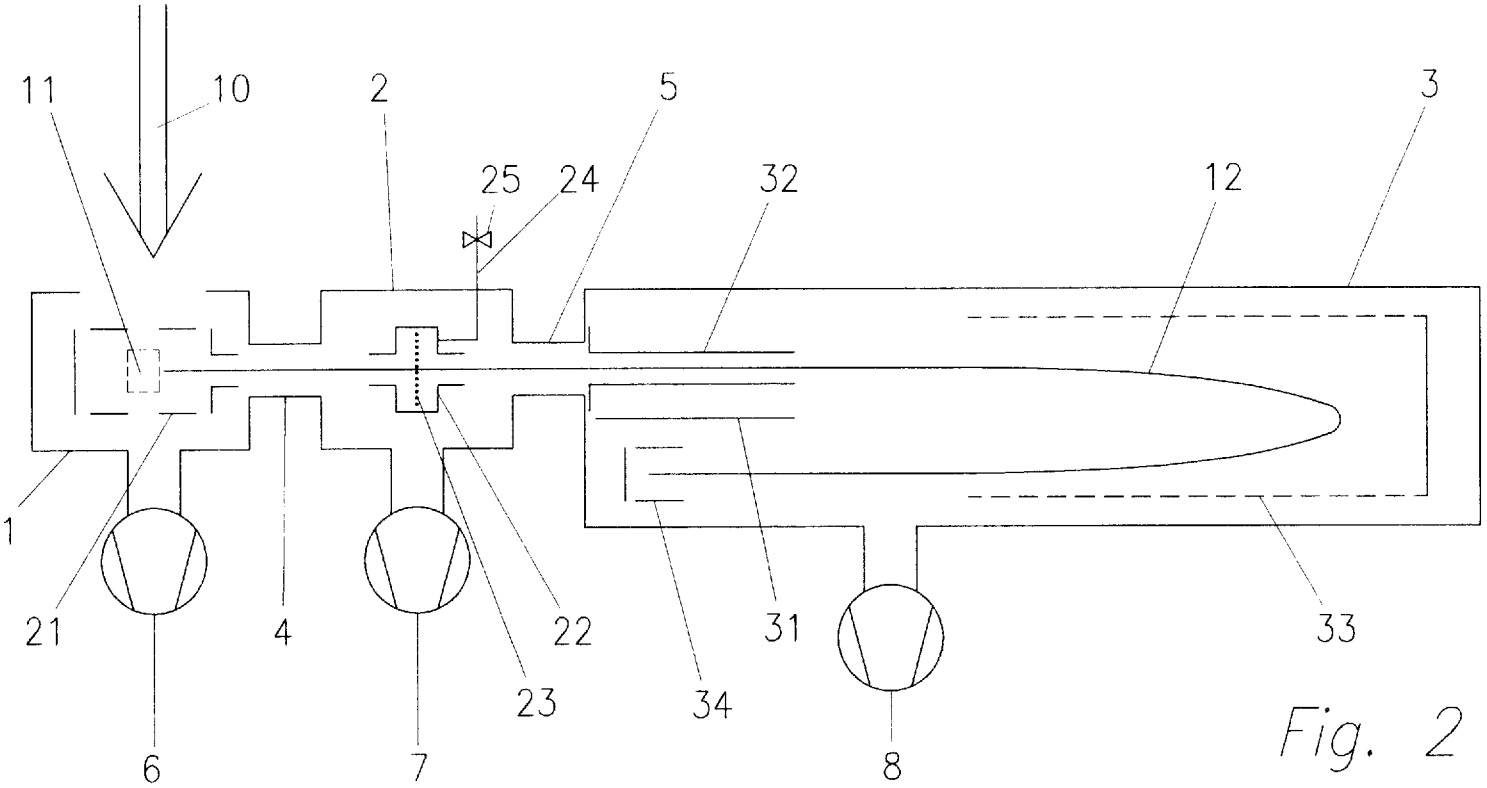
FIG. 2 shows an MS/MS-time-of-flight mass-spectrometer as a further embodiment of the invention.

FIG. 2 shows an MS/MS-time-of-flight mass-spectrometer with a collision cell according to the invention as an advantageous improvement of present time-of-flight mass-spectrometer designs.

The ion source(21) with its extraction volume(11) is shown within the ion source chamber(1). The ion source chamber is pumped by a pump(6) creating a base pressure preferrably below $10^{-6}$ mBar. At start-time of the mass analysis, those ions of the analyte beam(10) which are at that moment in the extraction volume of the ion source will be accelerated on paths(12) to the detector(34) of the mass spectrometer.

The collision chamber(2) is arranged closely behind the ion source chamber. These two chambers are connected via a tube(4) which serves also the purpose of a flow restriction. The collision cell(22) is located in the collision chamber. The collision gas can be fed to the collision cell through a line(24) and regulated by a valve(25). The collision chamber is pumped by a pump(7) that can preferrably achieve a base pressure below $10^{-5}$ mBar. The ion selector(23) is located within the collision cell.

Tubing(5) connects the reflector chamber(3). To prevent stray electrical fields from deflecting the ions, the paths must be shielded by some metal sheet(31) or by a tubing(32) containing the ion paths. This tubing can also serve the purpose of flow restriction between collision chamber and reflector chamber. The cross section of this tubing can be used to adjust its conductivity, preferrably to reduce it, as shown in FIG. 2. The reflector(33) will turn around the direction of flight for the ions so they can hit the detector (34), which is located in close proximity to the entrance tube to the reflector chamber. The reflector chamber is pumped by a pump(8) preferrably achieving a base pressure below $10^{-6}$ mBar.

This embodiment of the invention protects the detector and reflector from unduly high background gas pressures, the multichannel plates of the detector being the most sensitive component in this respect where pressures higher than $10^{-4}$ mBar will cause problems. This embodiment shows the ion source of the mass-spectrometer in a separate chamber since pressures higher than $10^{-3}$ mBar can lead to electrical discharge phenomena in this region.

Figure 3:
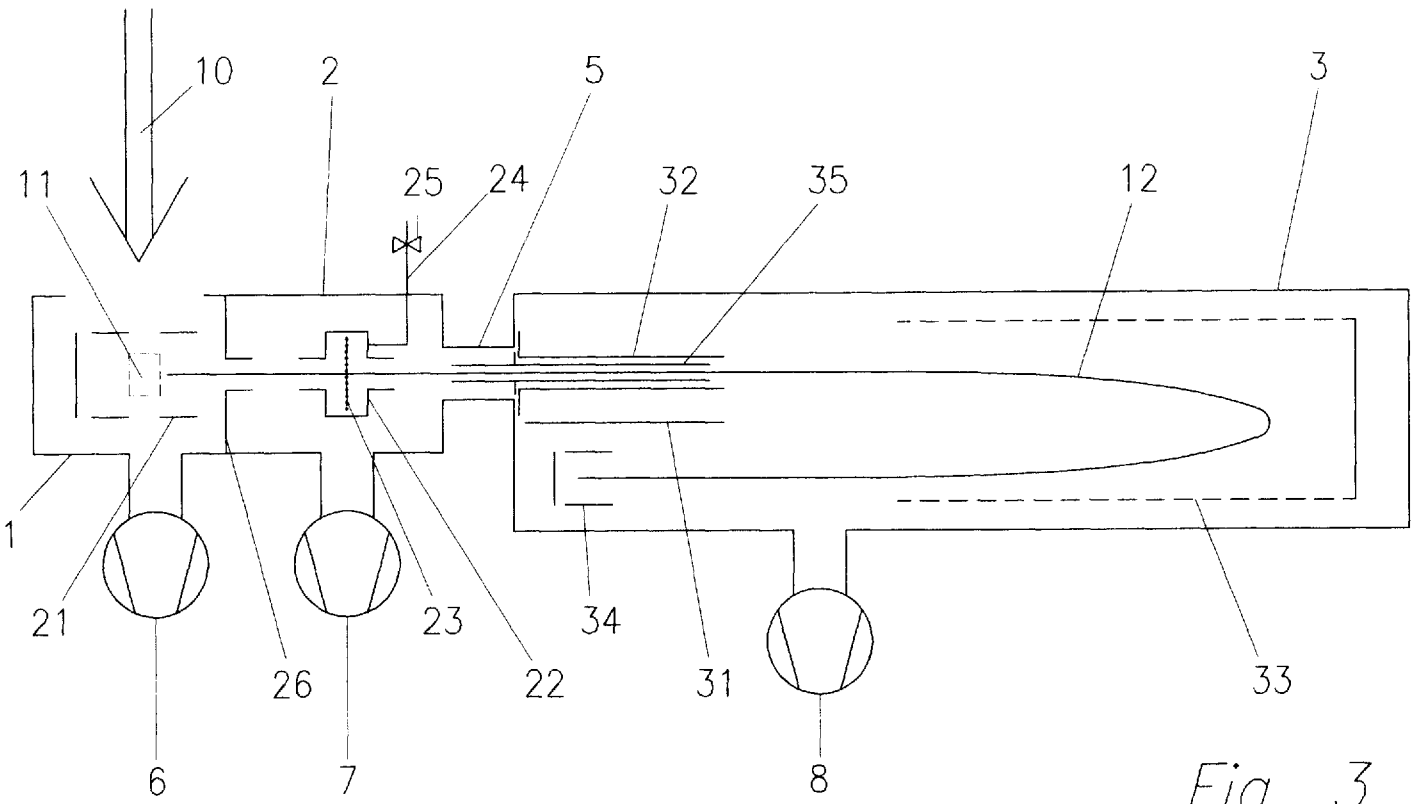
FIG. 3 shows another MS/MS-time-of-flight mass-spectrometer as a further embodiment of the invention.

FIG. 3 shows a further improved embodiment of the invention. Here the ion source and the collision chamber have been integrated into a single vacuum chamber which is split into two separately pumped vacuum regions by a plate(26) containing an aperture for the ion beam. This plate can also carry a tubing which will result in a flow restriction with lower conductivity.

Within the connecting tube(5) between the collision chamber(2) and the reflector chamber(3) and the entrance tube(32) to the reflector chamber another tubing(35) of smaller diameter is arranged which further reduces the gas conductivity between the collision chamber and the reflector chamber. Using a very long tubing here both within the connecting tube(5) and the entrance tube(32) will cause another reduction in gas conductivity.

What is claimed is:

1. An MS/MS-time-of-flight mass-spectrometer comprising an ion source(21), a reflector(33), a detector(34), an ion selector(23), and a collision cell(22), said collision cell having a port of entry for some collision gas causing the decomposition of primary ions to fragment ions, characterized by said ion selector(23) being arranged within the collision cell.

2. An MS/MS-time-of-flight mass-spectrometer according to claim 1, characterized by said collision cell(22) further comprising two flow restrictions(22*a,* 22*b*) for entry and exit of ions, said collision cell being arranged between and formed by the two flow restrictions.

3. An MS/MS-time-of-flight mass-spectrometer according to claim 1, characterized by a collision cell(22) that is mounted in its vacuum chamber by one of its flow restrictions(22*a,* 22*b*).

4. An MS/MS-time-of-flight mass-spectrometer according to claim 1, characterized by an ion selector(23), whose active plane is orthogonal to the ion optical axis and subdivides the collision cell(22) into two essentially symmetrical halves.

5. An MS/MS-time-of-flight mass-spectrometer according to claim 1, characterized by an ion selector(23) that is a parallel wire gate made of two sets of parallel wires located in one plane, each of these sets of wires mutually connected and independantly settable to a desired potential.

6. An MS/MS-time-of-flight mass-spectrometer according to claim 1, characterized by an ion selector(23) that is made of two plates located on opposite sides of the ion optical axis.

* * * * *